US008153573B2

(12) United States Patent
Miralles et al.

(10) Patent No.: US 8,153,573 B2
(45) Date of Patent: Apr. 10, 2012

(54) DEVELOPMENT OF AN ALUMINUM HYDROXYCARBOXYLATE BUILDER

(75) Inventors: Altony Miralles, Woodbury, MN (US); Gina F. Danielson, St. Paul, MN (US); Richard Dana Johnson, Minneapolis, MN (US); Michel Lawrence, Inver Grove Heights, MN (US); Jocelyn H. Chopskie, Apple Valley, MN (US)

(73) Assignee: Ecolab USA Inc., St. Paul, MI (US)

( * ) Notice: Subject to any disclaimer, the term of this patent is extended or adjusted under 35 U.S.C. 154(b) by 258 days.

(21) Appl. No.: 12/696,574

(22) Filed: Jan. 29, 2010

(65) Prior Publication Data

US 2010/0197558 A1 Aug. 5, 2010

Related U.S. Application Data

(60) Provisional application No. 61/148,820, filed on Jan. 30, 2009.

(51) Int. Cl.
*C11D 17/00* (2006.01)

(52) U.S. Cl. ..... 510/276; 510/488; 510/502; 510/508

(58) Field of Classification Search ..... None
See application file for complete search history.

(56) References Cited

U.S. PATENT DOCUMENTS

| | | | |
|---|---|---|---|
| 1,846,880 | A | 2/1932 | Kussmaul |
| 2,327,815 | A | 8/1943 | Niedercorn et al. |
| 3,011,977 | A | 12/1961 | Bernhard |
| 3,014,055 | A | 12/1961 | Johnson |
| 3,166,474 | A | 1/1965 | Sieger et al. |
| 3,200,136 | A | 8/1965 | Grossmith |
| 3,506,761 | A | 4/1970 | Rubino |
| 3,542,919 | A | 11/1970 | Buth et al. |
| 3,553,316 | A | 1/1971 | Rubino |
| 3,655,883 | A | 4/1972 | Granatek et al. |
| 3,712,948 | A | 1/1973 | Halpern et al. |
| 3,755,294 | A | 8/1973 | Walon |
| 3,798,168 | A | 3/1974 | Tumerman |
| 4,297,293 | A | 10/1981 | Suhac et al. |
| 4,354,940 | A | 10/1982 | Suhac et al. |
| 4,477,290 | A | 10/1984 | Carroll et al. |
| 4,495,186 | A | 1/1985 | Mora |
| 4,888,090 | A | 12/1989 | Sheetz |
| 5,110,494 | A | 5/1992 | Beck |
| 5,200,114 | A | 4/1993 | Beck |
| 5,417,287 | A | 5/1995 | Smith et al. |
| 5,472,512 | A | 12/1995 | Gober et al. |
| 5,614,010 | A | 3/1997 | Smith et al. |
| 5,622,569 | A | 4/1997 | Dennis et al. |
| 5,647,900 | A | 7/1997 | Smith et al. |
| 5,858,941 | A | 1/1999 | Oakes et al. |
| 6,372,715 | B1 | 4/2002 | Kaltwasser et al. |
| 2002/0076821 | A1 | 6/2002 | Beck et al. |
| 2003/0190355 | A1 | 10/2003 | Hermelin et al. |
| 2003/0216566 | A1 | 11/2003 | Kumari et al. |
| 2004/0038930 | A1 | 2/2004 | Beck et al. |
| 2004/0192995 | A1 | 9/2004 | Deshpande et al. |
| 2005/0209322 | A1 | 9/2005 | Rangisetty et al. |
| 2005/0256328 | A1 | 11/2005 | Justus et al. |
| 2006/0046964 | A1 | 3/2006 | Morneau |
| 2006/0134227 | A1 | 6/2006 | Bortz et al. |
| 2008/0287334 | A1 | 11/2008 | Smith et al. |
| 2009/0148579 | A1 | 6/2009 | Holliday et al. |
| 2010/0056415 | A1 * | 3/2010 | Rong et al. ..... 510/238 |

FOREIGN PATENT DOCUMENTS

EP 0401377 B1 12/1990

OTHER PUBLICATIONS

Gyurcsik, Bela et al., "Carbohydrates as ligands: coordination equilibria and structure of the metal complexes", Coordination Chemistry Reviews 203 (2000) 81-149.

International Search Report and Written Opinion issued in PCT/IB2010/50419, mailed Oct. 12, 2010, 9 pages.

Lakatos, A. et al., "A1III Ion Complexes of Saccharic Acid and Music Acid: A Solution and Solid State Study", Chem. Eur. J. 2004, 10, 1281-1290.

Lakatos, A. et al., "Complexes of A1(III) with D-Gluconic Acid", Polyhedron 27(2008) 118-124.

Motekaitis, R. et al., "Complexes of Aluminum (III) with Hydroxy Carboxylic Acids", Inorg. Chem., 1984, 23, 18-23.

Panda, C. et al., "Gluconate Complexes of Aluminum (III) and Iron (III)", Journal of the institution of Chemists (India) (1977), 49)6), 297-301.

Pecsok, Robert L. et al., "Gluconate complexes. II The ferric-gluconate system", Journal of the American Chemical Society 91955), 77, 1489-94.

Speers, R. Alex et al., "Effects of metal ions and gluconate on surface residues on returnable bottles", Technical Quarterly—Master Brewers Association of the Americas (2002), 39(1), 7-12.

Tanabe, Hideo et al., "Iron complexes. II. Preparation and properties of sodium ferric gluconate complex", Takeda Kenkyusho Nempo (1962), 21, 1-10 (Abstract only attached).

Tanabe, Hideo et al., "Iron complexes. III. Iron complex ions by paper electrophoresis", Takeda Kenkyusho Nempo (1962), 21, 11-19 (Abstract only attached).

Tanabe, Hideo et al., "Iron complexes. IV. Polarography of sodium ferric gluconate complex", Takeda Kenkyusho Nempo (1962), 21, 20-5 (Abstract only attached).

Tonkovic, M. et al., "Fructose and Sucrose Interactions with Hydrolyzed Aluminum (III)", Inorg. Chem. Acta 197 (1992) 59-65.

Tonkovic, M. et al., "Glucose and Glucoronic Acid Interactions with Hydrolysed Aluminum (III)", Polyhedron vol. 14 No. 8, pp. 1025-1030, 1995.

Traube, Wilhelm et al., "Ferric complex salts of aliphatic polyhydroxy compounds", Berichte der Deutschen Chemischen Gesellschaft [Abteilung] B: Abhandlungen (1933), 66B, 1545-56 (English Abstract Attached).

Van den Brink, P.J. et al., "Use of chelating agents for the preparation of iron oxide catalysts for the selective oxidation of hydrogen sulfide", Studies in Surface Science and Catalysis (1991), 63(Prep. Catal. 5), 527-36.

* cited by examiner

*Primary Examiner* — Necholus Ogden, Jr.
(74) *Attorney, Agent, or Firm* — Andrew D. Sorensen; Laura C. DiLorenzo

(57) ABSTRACT

A cleaning composition for removing soils includes an aluminum salt, a hydroxycarboxylate, an alkalinity source and optionally, a surfactant system. The cleaning composition has a pH of between about 9 and about 14.

20 Claims, No Drawings

DEVELOPMENT OF AN ALUMINUM HYDROXYCARBOXYLATE BUILDER

CROSS REFERENCE TO RELATED APPLICATIONS

This application claims the benefit of U.S. provisional application No. 61/148,820, filed Jan. 30, 2009, entitled "Development of an Aluminum Hydroxycarboxylate Builder", the disclosure of which is hereby incorporated by reference in its entirety.

TECHNICAL FIELD

The present invention is related to the field of detergents. In particular, the present invention is related to a detergent composition including aluminum hydroxycarboxylates as a builder.

BACKGROUND

Conventional detergents used in the vehicle care, food and beverage (e.g., the dairy, cheese, sugar, meat, food, and brewery and other beverage industries), warewashing and laundry industries include alkaline detergents. Alkaline detergents, particularly those intended for institutional and commercial use, generally contain phosphates, nitrilotriacetic acid (NTA) and ethylenediaminetetraacetic acid (EDTA). Phosphates, NTA and EDTA are components commonly used in detergents to remove soils and to sequester metal ions such as calcium, magnesium and iron.

In particular, NTA, EDTA or polyphosphates such as sodium tripolyphosphate and their salts are used in detergents because of their ability to solubilize preexisting inorganic salts and/or soils. When calcium, magnesium and iron salts precipitate, the crystals may attach to the surface being cleaned and cause undesirable effects. For example, calcium carbonate precipitation on the surface of ware can negatively impact the aesthetic appearance of the ware, giving an unclean look. In the laundering area, if calcium carbonate precipitates and attaches onto the surface of fabric, the crystals may leave the fabric feeling hard and rough to the touch. In the food and beverage industry, the calcium carbonate residue can affect the acidity levels of foods. The ability of NTA, EDTA and polyphosphates to remove metal ions facilitates the detergency of the solution by preventing hardness precipitation, assisting in soil removal and/or preventing soil redeposition into the wash solution or wash water.

While effective, phosphates and NTA are subject to government regulations due to environmental and health concerns. Although EDTA is not currently regulated, it is believed that government regulations may be implemented due to environmental persistence. There is therefore a need in the art for an alternative, and preferably environment friendly, cleaning composition that can replace the properties of phosphorous-containing compounds such as phosphates, phosphonates, phosphites, and acrylic phosphinate polymers, as well as non-biodegradable aminocarboxylates such as NTA and EDTA.

SUMMARY

A present invention includes a cleaning composition for removing soils. The cleaning composition includes an aluminum salt, a hydroxycarboxylate, an alkalinity source and optionally, a surfactant system. The cleaning composition has a pH of between about 9 and about 14.

In one embodiment, the present invention is a detergent composition including between about 0.01% and about 60% aluminum hydroxycarboxylate and between about 0.8% and about 90% alkalinity source. The aluminum hydroxycarboxylate is selected from one of aluminum gluconate, aluminum glucoheptonate, aluminum mucate, aluminum tartrate, aluminum glucarate, aluminum saccharate and aluminum malate.

In yet another embodiment, the aluminum hydroxycarboxylate is used in a method of removing soils. An alkali metal salt of a hydroxycarboxylate or free hydroxycarboxylic acid is mixed with an aluminum salt dissolved with an alkali metal hydroxide to form an aluminum hydroxycarboxylate. The aluminum hydroxycarboxylate is then mixed with an alkalinity source to form a cleaning composition. The detergent composition is then contacted with a substrate to be cleaned. Prior to contacting the substrate with the detergent composition, the detergent composition may be diluted at a dilution ratio of between about 1:10 and about 1:10,000 to form a use solution.

While multiple embodiments are disclosed, still other embodiments of the present invention will become apparent to those skilled in the art from the following detailed description, which shows and describes illustrative embodiments of the invention.

DETAILED DESCRIPTION

The present invention relates to detergent compositions including an aluminum hydroxycarboxylate as a builder. Detergent compositions including an aluminum hydroxycarboxylate exhibit detergency, soil suspension and anti-redeposition properties. The detergent compositions can be applied in any environment where it is desirable to remove soils and to prevent the precipitation of magnesium, calcium and iron. For example, the detergent compositions can be used in vehicle care applications, warewashing applications, laundering applications and food and beverage applications. Such applications include, but are not limited to: machine and manual warewashing, presoaks, laundry and textile cleaning and destaining, carpet cleaning and destaining, vehicle cleaning and care applications, surface cleaning and destaining, kitchen and bath cleaning and destaining, floor cleaning and destaining, cleaning in place operations, general purpose cleaning and destaining, and industrial or household cleaners. Methods of using the detergent compositions are also provided.

Unlike most detergent compositions currently known in the art, the detergent compositions of the present invention do not require that phosphorous, nitrilotriacetic acid (NTA) or ethylenediaminetetraacetic acid (EDTA) be present in order to be effective. Thus, the detergent compositions may be biodegradable and substantially free of phosphorous and aminocarboxylates such as NTA and EDTA, making the detergent compositions particularly useful in cleaning applications where it is desired to use an environmentally friendly detergent composition.

The detergent compositions generally include an aluminum hydroxycarboxylate, an alkalinity source, and optionally, a surfactant or surfactant system. When a surfactant or surfactant system is included in the detergent compositions, a suitable concentration range of the components in the detergent compositions includes between approximately 1% and approximately 60% by weight aluminum hydroxycarboxylate, between approximately 5% and approximately 80% by weight alkalinity source and between approximately 0.01% and approximately 50% by weight surfactant or surfactant system. A particularly suitable concentration range of the components in the detergent compositions includes between approximately 1% and approximately 45% by weight aluminum hydroxycarboxylate, between approximately 20% and approximately 75% by weight alkalinity source and between approximately 0.5% and approximately 40% by weight surfactant or surfactant system.

In some embodiments, the detergent compositions do not include a surfactant or surfactant system and only includes an aluminum hydroxycarboxylate, an alkalinity source, and water. A suitable concentration range of the components in the detergent compositions includes between approximately 0.01% and approximately 60% by weight aluminum hydroxycarboxylate, between approximately 0.8% and approximately 90% by weight alkalinity source and between approximately 1% and approximately 99.5% by weight water. A particularly suitable concentration range of the components in the detergent compositions includes between approximately 0.01% and approximately 30% by weight aluminum hydroxycarboxylate, between approximately 10% and approximately 50% by weight alkalinity source and between approximately 10% and approximately 80% by weight water. A more particularly suitable concentration range of the components in the detergent compositions includes between approximately 0.01% and approximately 5% by weight aluminum hydroxycarboxylate, between approximately 40% and approximately 48% by weight alkalinity source and between approximately 40% and approximately 60% by weight water.

The aluminum hydroxycarboxylate is made by reacting the appropriate alkali metal salt (Li, Na, K, Rb, Cs) of the hydroxycarboxylate or the free hydroxycarboxylic acid with an aluminum salt or aluminate ("aluminum salt") dissolved with an alkali metal hydroxide. Examples of suitable aluminum salts dissolved with an alkali metal hydroxide include, but are not limited to, sodium aluminate and aluminum chloride. Examples of suitable aluminum hydroxycarboxylates include, but are not limited to: aluminum gluconate, aluminum glucoheptonate, aluminum mucate, aluminum tartrate, aluminum glucarate, aluminum saccharate and aluminum malate. A particularly suitable aluminum hydroxycarboxylate is aluminum gluconate. The molar ratio of the alkali metal salt of the hydroxycarboxylate or the free hydroxycarboxylic acid to aluminum salt dissolved with an alkali metal hydroxide is at least about 1:1 and particularly about 1:1. For example, a suitable molar ratio for aluminum gluconate is between about 0.5:1.5 and about 1.5:0.5 gluconic acid to sodium aluminate. The weight ratio of the alkali metal salt of the hydroxycarboxylate or the free hydroxycarboxylic acid to aluminum salt dissolved with an alkali metal hydroxide is between about 40:60 and about 95:1.

The detergent compositions also include an alkalinity source, such as an alkali metal hydroxide, alkali metal carbonate, or alkali metal silicate. Examples of suitable alkalinity sources include, but are not limited to: sodium hydroxide, potassium hydroxide, sodium carbonate, potassium carbonate or a mixture of alkali metal hydroxide and alkali metal carbonate. The alkalinity source controls the pH of the resulting solution when water is added to the detergent composition to form a use solution. The pH of the use solution must be maintained in the alkaline range in order to provide sufficient detergency properties. In an embodiment, the pH of the use solution is between approximately 9 and approximately 12. Particularly, the pH of the use solution is between about 10 and about 12. More particularly, the pH of the use solution is between about 11 and about 12. If the pH of the use solution is too low, for example, below approximately 9, the use solution may not provide adequate detergency properties. If the pH of the use solution is too high, for example, above approximately 12, the use solution may be too alkaline and attack or damage the surface to be cleaned if the surface is not stainless steel or resistant to corrosion. For example, the pH of the use solution may be between about 9 and 12 in a laundry or warewashing composition. In an embodiment, the pH of the use solution is between about 12 and about 13.5 and the pH of the concentrate is between about 13 and 14. For example, the pH of the use solution may be between about 12 and about 13.5 in a food and beverage composition and thus includes industrial strength alkalinity.

The detergent compositions may also include a surfactant or surfactant system. A variety of surfactants may be used, including anionic, nonionic, cationic, and zwitterionic surfactants. For a discussion of surfactants, see Kirk-Othmer, Encyclopedia of Chemical Technology, Third Edition, volume 8, pages 900-912, which is incorporated herein by reference.

Examples of suitable anionic surfactants useful in the detergent compositions include, but are not limited to: carboxylates such as alkylcarboxylates (carboxylic acid salts) and polyalkoxycarboxylates, alcohol ethoxylate carboxylates, nonylphenol ethoxylate carboxylates and the like; sulfonates such as alkylsulfonates, alkylbenzenesulfonates, alkylarylsulfonates, sulfonated fatty acid esters and the like; sulfates such as sulfated alcohols, sulfated alcohol ethoxylates, sulfated alkylphenols, alkylsulfates, sulfosuccinates, alkylether sulfates and the like. Some particularly suitable anionic surfactants include, but are not limited to: sodium alkylarylsulfonate, alpha-olefinsulfonate and fatty alcohol sulfates.

Nonionic surfactants useful in the detergent compositions include those having a polyalkylene oxide polymer as a portion of the surfactant molecule. Examples of suitable nonionic surfactants include, but are not limited to: chlorine-, benzyl-, methyl-, ethyl-, propyl, butyl-and alkyl-capped polyethylene glycol ethers of fatty alcohols; polyalkylene oxide free nonionics such as alkyl polyglucosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates and the like; nonylphenol ethoxylate, polyoxyethylene glycol ethers and the like; carboxylic acid esters such as glycerol esters, polyoxyethylene esters, ethoxylated and glycol esters of fatty acids and the like; carboxylic amides such as diethanolamine condensates, monoalkanolamine condensates, polyoxyethylene fatty acid amides and the like; and polyalkylene oxide block copolymers including an ethylene oxide/propylene oxide block copolymer. Examples of suitable commercially available nonionic surfactants include, but are not limited to: PLURONIC, available from BASF Corporation, Florham Park, N.J. and ABIL B8852, available from Goldschmidt Chemical Corporation, Hopewell, Va.

Cationic surfactants useful for inclusion in the detergent compositions include, but are not limited to: amines such as primary, secondary and tertiary amines with C18 alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline and the like; and quaternary ammonium salts, as for example, alkylquaternary ammonium chloride surfactants such as n-alkyl(C12-C18)dimethylbenzyl ammonium chloride, n-tetradecyldimethylbenzylammonium chloride monohydrate, and naphthalene-substituted quaternary ammonium chlorides such as dimethyl-1-naphthylmethylammonium chloride. For a more extensive list of surfactants, see McCutcheon's Emulsifiers and Detergents, which is incorporated herein by reference.

In some embodiments, any surfactant or surfactant system included in the detergent compositions of the present invention include either low-foaming or de-foaming surfactants. For example, low-foaming surfactants or surfactant system may be added to a food and beverage composition. Low foaming surfactants that provide the desired level of detersive activity are advantageous in environments where the presence of large amounts of foaming can be problematic. Accordingly, surfactants that are considered low foaming surfactants can be used. In addition, other surfactants can be used in conjunction with a defoaming agent to control the level of foaming.

The detergent compositions of the present invention can be provided in any of a variety of embodiments of detergent compositions. In an embodiment, the detergent composition is substantially free of phosphorous-containing compounds, nitrilotriacetic acid (NTA) and ethylenediaminetetraacetic acid (EDTA). Substantially phosphorous-free refers to a composition to which phosphorous-containing compounds are not added. Should phosphorus-containing compounds be present through contamination, the level of phosphorus-containing compounds in the resulting composition is less than approximately 10 wt %, less than approximately 5 wt %, less than approximately 1 wt %, less than approximately 0.5 wt %, less than approximately 0.1 wt %, and often less than approximately 0.01 wt %. Substantially NTA or EDTA-free refers to a composition to which NTA or EDTA are not added. Should NTA or EDTA be present through contamination, the level of NTA or EDTA in the resulting composition is less than approximately 10 wt %, less than approximately 5 wt %, less than approximately 1 wt %, less than approximately 0.5 wt %, less than approximately 0.1 wt %, and often less than approximately 0.01 wt %. When the detergent composition is NTA-free, the detergent composition is also compatible with chlorine, which functions as an anti-redeposition and stain-removal agent. When diluted to a use solution, the detergent composition includes phosphorous-containing components, NTA and EDTA concentrations of less than approximately 100 ppm, particularly less than approximately 10 ppm, and more particularly less than approximately 1 ppm.

Additional Functional Materials

The detergent compositions may contain other functional materials that provide desired properties and functionalities to the detergent compositions. For the purpose of this application, the term "functional materials" includes a material that when dispersed or dissolved in a use and/or concentrate solution, such as an aqueous solution, provides a beneficial property in a particular use. Examples of such functional materials include, but are not limited to: organic detergents, cleaning agents; rinse aids; bleaching agents; sanitizers/antimicrobial agents; activators; detergent builders or fillers; defoaming agents, anti-redeposition agents; optical brighteners; dyes/odorants; secondary hardening agents/solubility modifiers; pesticides for pest control applications; or the like, or a broad variety of other functional materials, depending upon the desired characteristics and/or functionality of the detergent composition.

In particular, the detergent compositions may include a threshold system as disclosed in co-pending application titled "High Alkaline Detergent Composition With Enhanced Scale Control" which is incorporated herein by reference. Some more particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Rinse Aids

The detergent compositions can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Bleaching Agents

The detergent compositions can optionally include a bleaching agent for lightening or whitening a substrate, and can include bleaching compounds capable of liberating an active halogen species, such as $Cl_2$, $Br_2$, —OCl— and/or —OBr—, or the like, under conditions typically encountered during the cleansing process. Examples of suitable bleaching agents include, but are not limited to: chlorine-containing compounds such as chlorine, a hypochlorite or chloramines. Examples of suitable halogen-releasing compounds include, but are not limited to: alkali metal dichloroisocyanurates, alkali metal hypochlorites, monochloramine, and dichloroamine. Encapsulated chlorine sources may also be used to enhance the stability of the chlorine source in the composition (see, for example, U.S. Pat. Nos. 4,618,914 and 4,830,773, the disclosures of which are incorporated by reference herein). The bleaching agent may also include an agent containing or acting as a source of active oxygen. The active oxygen compound acts to provide a source of active oxygen and may release active oxygen in aqueous solutions. An active oxygen compound can be inorganic, organic or a mixture thereof. Examples of suitable active oxygen compounds include, but are not limited to: peroxygen compounds, peroxygen compound adducts, hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine.

Sanitizers/Anti-Microbial Agents

The detergent compositions can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes"

and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the detergent compositions can be enhanced by the addition of a material which, when the detergent composition is placed in use, reacts with the active oxygen to form an activated component. For example, in some embodiments, a peracid or a peracid salt is formed. For example, in some embodiments, tetraacetylethylene diamine can be included within the detergent composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, the detergent compositions are in the form of a solid block, and an activator material for the active oxygen is coupled to the solid block. The activator can be coupled to the solid block by any of a variety of methods for coupling one solid detergent composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the detergent compositions, such as by a plastic or shrink wrap or film.

Detergent Builders or Fillers

The detergent compositions can optionally include a minor but effective amount of one or more of a detergent filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and C1-C10 alkylene glycols such as propylene glycol.

pH Buffering Agents

Additionally, the detergent compositions can be formulated such that during use in aqueous operations, for example in aqueous cleaning operations, the wash water will have a desired pH. For example, compositions designed for use in providing a presoak composition may be formulated such that during use in aqueous cleaning operations the wash water will have a pH in the range of about 6.5 to about 12, and in some embodiments, in the range of about 7.5 to about 11. Liquid product formulations in some embodiments have a (10% dilution) pH in the range of about 7.5 to about 11.0, and in some embodiments, in the range of about 7.5 to about 9.0.

For example, a souring agent may be added to the detergent compositions such that the pH of the textile approximately matches the proper processing pH. The souring agent is a mild acid used to neutralize residual alkalines and reduce the pH of the textile such that when the garments come into contact with human skin, the textile does not irritate the skin. Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Fabric Relaxants

A fabric relaxant may be added to the detergent compositions to increase the smoothness appearance of the surface of the textile.

Fabric Softeners

A fabric softener may also be added to the detergent compositions to soften the feel of the surface of the textile. An example of a suitable commercially available fabric softener includes, but is not limited to, TurboFresh, available from Ecolab Inc., St. Paul, Minn.

Soil Releasing Agents

The detergent compositions can include soil releasing agents that can be provided for coating the fibers of textiles to reduce the tendency of soils to attach to the fibers. Examples of suitable commercially available soil releasing agents include, but are not limited to: polymers such as Repel-O-Tex SRP6 and Repel-O-Tex PF594, available from Rhodia, Cranbury, N.J.; TexaCare 100 and TexaCare 240, available from Clariant Corporation, Charlotte, N.C.; and Sokalan HP22, available from BASF Corporation, Florham Park, N.J.

Defoaming Agents

The detergent compositions can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

The detergent compositions can optionally include an anti-redeposition agent capable of facilitating sustained suspension of soils in a cleaning solution and preventing the removed soils from being redeposited onto the substrate being cleaned. Examples of suitable anti-redeposition agents include, but are not limited to: fatty acid amides, fluorocarbon surfactants, complex phosphate esters, polyacrylates, styrene maleic anhydride copolymers, and cellulosic derivatives such as hydroxyethyl cellulose, hydroxypropyl cellulose.

Stabilizing Agents

The detergent compositions may also include stabilizing agents. Examples of suitable stabilizing agents include, but are not limited to: borate, calcium/magnesium ions, propylene glycol, and mixtures thereof.

Dispersants

The detergent compositions may also include dispersants. Examples of suitable dispersants that can be used in the detergent compositions include, but are not limited to: maleic acid/olefin copolymers, polyacrylic acid, and mixtures thereof.

Optical Brighteners

The detergent compositions can optionally include an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal 5 BM-GX, Tinopal CBS-CL, Tinopal CBS-X, and Tinopal AMS-GX, available from Ciba Specialty Chemicals Corporation, Greensboro, N.C. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene.

Anti-Static Agents

The detergent compositions can include an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

Anti-Wrinkling Agents

The detergent compositions can include anti-wrinkling agents to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes. Examples of commercially available anti-wrinkling agents include, but are not limited to: Rewoquat SQ24, available from Degussa/Goldschmidt Chemical Corporation, Hopewell, Va.; Lube CSI-Q, available from Lambent Technologies; and Tinotex CMA, available from Ciba Specialty Chemicals Corporation, Greensboro, N.C.

Odor-Capturing Agents

The detergent compositions can include odor capturing agents. In general, odor capturing agents are believed to function by capturing or enclosing certain molecules that provide an odor. Examples of suitable odor capturing agents include, but are not limited to: cyclodextrins and zinc ricinoleate.

Fiber Protection Agents

The detergent compositions can include fiber protection agents that coat the fibers of the textile to reduce or prevent disintegration and/or degradation of the fibers. An example of a fiber protection agent includes, but is not limited to, cellulosic polymers.

Color Protection Agents

The detergent compositions can include color protection agents for coating the fibers of a textile to reduce the tendency of dyes to escape the textile into water. Examples of suitable color protection agents include, but are not limited to: quaternary ammonium compounds and surfactants. Examples of particularly suitable color protection agents include, but are not limited to: di-(nortallow carboxyethyl)hydroxyethyl methyl ammonium methylsulfate and cationic polymers. Examples of commercially available surfactant color protection agents include, but are not limited to: Varisoft WE 21 CP and Varisoft CCS-1, available from Degussa/Goldschmidt Chemical Corporation, Hopewell, Va.; Tinofix CL from Ciba Specialty Chemicals Corporation, Greensboro, N.C.; Color Care Additive DFC 9, Thiotan TR, Nylofixan P-Liquid, Polymer VRN, Cartaretin F-4, and Cartaretin F-23, available from Clariant Corporation, Charlotte, N.C.; EXP 3973 Polymer, available from Alcoa Inc., Pittsburgh, Pa.; and Coltide, available from Croda International Plc, Edison N.J.

Dyes/Odorants

Various dyes, odorants including perfumes, and other aesthetic enhancing agents may also be included in the detergent compositions. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

UV Protection Agents

The detergent compositions can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An example of a suitable commercially available UV protection agent includes, but is not limited to, Tinosorb FD, available from Ciba Specialty Chemicals Corporation, Greensboro, N.C.

Anti-Pilling Agents

The detergent compositions can include an anti-pilling agent that acts on portions of fibers that stick out or away from the fiber. Anti-pilling agents can be available as enzymes such as cellulase enzymes. Examples of commercially available anti-pilling agents include, but are not limited to: Puradex, available from Genencor International, Palo Alto, Calif.; and Endolase and Carezyme, available from Novozyme, Franklinton, N.C.

Water Repellency Agents

The detergent compositions can include water repellency agents that can be applied to textile to enhance water repellent properties. Examples of stuiable water repellenancy agents include, but are not limited to: perfluoroacrylate copolymers, hydrocarbon waxes, and polysiloxanes.

Hardening Agents/Solubility Modifiers

The detergent compositions may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the cleaning agent and/or other active ingredients may be dispensed from the solid composition over an extended period of time.

Glass and Metal Corrosion Inhibitors

The detergent compositions may include a metal corrosion inhibitor in an amount up to approximately 30% by weight, up to approximately 6% by weight, and up to approximately 2% by weight. The corrosion inhibitor is included in the detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. The use solution can include between approximately 6 ppm and approximately 300 ppm of the corrosion inhibitor, and between approximately 20 ppm and approximately 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

By controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be between at least approximately 6:1, can be less than approximately 1:20, and can be between approximately 2:1 and approximately 1:15.

An effective amount of an alkaline metal silicate or hydrate thereof can be employed in the compositions and processes of the invention to form a stable solid detergent composition having metal protecting capacity. The silicates employed in the compositions of the invention are those that have conventionally been used in solid detergent formulations. For example, typical alkali metal silicates are those powdered, particulate or granular silicates which are either anhydrous or preferably which contain water of hydration (approximately 5% to approximately 25% by weight, particularly approximately 15% to approximately 20% by weight water of hydration). These silicates are preferably sodium silicates and have a $Na_2O:SiO_2$ ratio of approximately 1:1 to approximately 1:5, respectively, and typically contain available water in the amount of from approximately 5% to approximately 25% by weight. In general, the silicates have a $Na_2O:SiO_2$ ratio of approximately 1:1 to approximately 1:3.75, particularly approximately 1:1.5 to approximately 1:3.75 and most particularly approximately 1:1.5 to approximately 1:2.5. A silicate with a $Na_2O:SiO_2$ ratio of approximately 1:2 and approximately 16% to approximately 22% by weight water of hydration, is most preferred. For example, such silicates are available in powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, a $Na_2O:SiO_2$ ratio of approximately 1:1.5 to approximately 1:2.5, have been found to provide the optimum metal protection and rapidly form a solid detergent. Hydrated silicates are preferred.

Silicates can be included in the detergent composition to provide for metal protection but are additionally known to provide alkalinity and additionally function as anti-redeposition agents. Exemplary silicates include, but are not limited to: sodium silicate and potassium silicate. The detergent composition can be provided without silicates, but when silicates are included, they can be included in amounts that provide for desired metal protection. The concentrate can include silicates in amounts of at least approximately 1% by weight, at least approximately 5% by weight, at least approximately 10% by weight, and at least approximately 15% by weight. In addition, in order to provide sufficient room for other components in the concentrate, the silicate component can be provided at a level of less than approximately 35% by weight, less than approximately 25% by weight, less than approximately 20% by weight, and less than approximately 15% by weight.

Enzymes

Enzymes that can be included in the detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the detergent composition is provided as a use composition. Exemplary ranges of the enzyme in the concentrate include up to approximately 10% by weight, up to approximately 5% by weight, and up to approximately 1% by weight.

Anti-Scaling Agents

The detergent compositions may include an anti-scaling agent. In one embodiment, the anti-scaling agent comprises about 0.25 wt % to about 10 wt % of the detergent composition. In some embodiments, the anti-scaling agent comprises about 2 to about 5 wt % of the detergent composition. In still yet other embodiments, the anti-scaling agent comprises about 0.5 to about 1.5 wt % of the detergent composition. It is to be understood that all values and ranges between these values and ranges are encompassed by the present invention.

In some embodiments, an effective amount of anti-scaling agent is applied to industrial food processing equipment such that the scale on the equipment is substantially removed. In some embodiments, at least about 10% of scale deposition is removed from the equipment. In other embodiments, at least about 25% of scale deposition is removed. In still yet other embodiments, at least about 50% of scale deposition is removed. In some embodiments, about 90% of scale deposition is removed.

In some embodiments, an effective amount of anti-scaling agent is applied to industrial food processing equipment such that formation of scale on the equipment is substantially prevented. In some embodiments, at least about 10% of scale deposition is prevented. In other embodiments, at least about 25% of scale deposition is prevented. In still yet other embodiments, at least about 50% of scale deposition is prevented. In some embodiments, about 90% of scale deposition is prevented.

Oxidizing Agents

The detergent composition can further comprise an oxidizing agent or an oxidizer, such as a peroxide or peroxyacid. Suitable ingredients are oxidants such as chlorites, bromine, bromates, bromine monochloride, iodine, iodine monochloride, iodates, permanganates, nitrates, nitric acid, borates, perborates, and gaseous oxidants such as ozone, oxygen, chlorine dioxide, chlorine, sulfur dioxide and derivatives thereof. Peroxygen compounds, which include peroxides and various percarboxylic acids, including percarbonates, are suitable.

Peroxycarboxylic (or percarboxylic) acids generally have the formula $R(CO_3H)_n$, where, for example, R is an alkyl, arylalkyl, cycloalkyl, aromatic, or heterocyclic group, and n is one, two, or three, and named by prefixing the parent acid with peroxy. The R group can be saturated or unsaturated as well as substituted or unsubstituted. Medium chain peroxycarboxylic (or percarboxylic) acids can have the formula $R(CO_3H)_n$, where R is a $C_5$—C $C_{11}$ alkyl group, a $C_5$—C $C_{11}$ cycloalkyl, a $C_5$-$C_{11}$ arylalkyl group, $C_5$—C $C_{ii}$ aryl group, or a $C_5$-$C_{11}$ heterocyclic group; and n is one, two, or three. Short chain fatty acids can have the formula $R(CO_3H)_n$ where R is $C_1$-$C_4$ and n is one, two, or three.

Examples of suitable peroxycarboxylic acids include, but are not limited to: peroxypentanoic, peroxyhexanoic, peroxyheptanoic, peroxyoctanoic, peroxynonanoic, peroxyisononanoic, peroxydecanoic, peroxyundecanoic, peroxydodecanoic, peroxyascorbic, peroxyadipic, peroxycitric, peroxypimelic, or peroxysuberic acid, mixtures thereof, or the like.

Examples of suitable branched chain peroxycarboxylic acid include, but are not limited to: peroxyisopentanoic, peroxyisononanoic, peroxyisohexanoic, peroxyisoheptanoic, peroxyisooctanoic, peroxyisonananoic, peroxyisodecanoic, peroxyisoundecanoic, peroxyisododecanoic, peroxyneopentanoic, peroxyneohexanoic, peroxyneoheptanoic, peroxyneooctanoic, peroxyneononanoic, peroxyneodecanoic, peroxyneoundecanoic, peroxyneododecanoic, mixtures thereof, or the like.

Typical peroxygen compounds include hydrogen peroxide ($H_2O_2$), peracetic acid, peroctanoic acid, a persulphate, a perborate, or a percarbonate.

The amount of oxidant in the detergent composition, if present, is up to approximately 40 wt %. Acceptable levels of oxidant are up to approximately 10 wt %, with up to approximately 5% being a particularly suitable level.

Solvents

The detergent composition may include a solvent to enhance soil removal properties or to adjust the viscosity of the final composition. Suitable solvents useful in removing hydrophobic soils include, but are not limited to: oxygenated solvents such as lower alkanols, lower alkyl ethers, glycols, aryl glycol ethers and lower alkyl glycol ethers. Examples of other solvents include, but are not limited to: methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include, not are not limited to: propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether and the like.

When a solvent is included in the detergent composition, it may be included in an amount of up to approximately 25% by weight, particularly up to approximately 15% by weight and more particularly up to about 5% by weight.

Insect Repellants

The detergent compositions can include insect repellents such as mosquito repellents. An example of a commercially available insect repellent is DEET. In addition, the aqueous carrier solution can include mildewcides that kill mildew and allergicides that reduce the allergic potential present on certain textiles and/or provide germ proofing properties.

Other Ingredients

A wide variety of other ingredients useful in providing the particular detergent composition being formulated to include desired properties or functionality may also be included. For example, the detergent compositions may include other active ingredients, cleaning enzyme, carriers, processing aids, solvents for liquid formulations, or others, and the like.

EMBODIMENTS

The present invention relates to liquid and solid detergent compositions including an aluminum hydroxycarboxylate as the builder. When the detergent composition is provided as a liquid, the present invention includes a gel or paste. When the detergent composition is provided as a solid, the detergent composition may take forms including, but not limited to: a cast, extruded, molded or formed solid pellet, block, tablet, powder, granule, flake and the like.

Exemplary ranges for components of the detergent compositions when provided as a concentrated laundry detergent, a concentrated warewashing detergent and a concentrated food and beverage detergent are shown in Tables 1, 2 and 3, respectively.

TABLE 1

Laundry Composition

| Component | First Exemplary Range (wt %) | Second Exemplary Range (wt %) | Third Exemplary Range (wt %) |
|---|---|---|---|
| Water | 5-60 | 10-35 | 15-25 |
| Alkalinity Source | 5-60 | 10-50 | 20-40 |
| Silicate | 0-35 | 5-25 | 10-20 |
| Aluminum Hydroxycarboxylate | 1-45 | 2-20 | 2-5 |
| Stabilizer | 0-20 | 0.5-15 | 2-10 |
| Dispersant | 0-20 | 0.5-15 | 2-9 |
| Enzyme | 0-15 | 0.5-10 | 1-5 |
| Corrosion Inhibitor | 0.01-15 | 0.5-10 | 1-5 |
| Surfactant | 5-50 | 10-40 | 15-35 |
| Fragrance | 0-10 | 0.01-5 | 0.1-2 |
| Dye | 0-1 | 0.001-0.5 | 0.01-0.25 |

TABLE 2

Warewashing Composition

| Component | First Exemplary Range (wt %) | Second Exemplary Range (wt %) | Third Exemplary Range (wt %) |
|---|---|---|---|
| Water | 0-50 | 1-40 | 5-30 |
| Alkalinity Source | 5-80 | 20-75 | 50-70 |
| Aluminum Hydroxycarboxylate | 1-60 | 5-50 | 10-40 |
| Bleach | 0-55 | 5-45 | 10-35 |
| Silicate | 0-35 | 5-25 | 10-15 |
| Dispersant | 0-10 | 0.001-5 | 0.01-1 |
| Enzyme | 0-15 | 1-10 | 2-5 |
| Corrosion Inhibitor | 0.01-15 | 0.05-10 | 1-5 |
| Surfactant | 0-2 | 0.5-1.5 | 0.5-1.5 |
| Fragrance | 0-10 | 0.01-5 | 0.1-2 |
| Dye | 0-1 | 0.001-0.5 | 0.01-0.25 |

TABLE 3

Food and Beverage Composition

| Component | First Exemplary Range (wt %) | Second Exemplary Range (wt %) | Third Exemplary Range (wt %) |
|---|---|---|---|
| Water | 1-99.5 | 10-80 | 40-60 |
| Alkalinity Source | 0.8-90 | 10-50 | 40-48 |
| Aluminum Hydroxycarboxylate | 0.01-60 | 0.01-30 | 0.01-5 |
| Silicate | 0-65 | 0-21 | 0-10 |
| Enzyme | 0-10 | 0-5 | 0-1 |
| Corrosion Inhibitor | 0-30 | 0-6 | 0-2 |
| Oxidizing Agent | 0-40 | 0-10 | 0-5 |
| Penetrant/Solvent | 0-25 | 0-15 | 0-5 |
| Solubility Modifiers | 0-60 | 0-40 | 0-5 |
| Surfactant | 0-30 | 0-15 | 0-5 |
| Fragrance | 0-10 | 0.01-5 | 0.1-2 |
| Dye | 0-1 | 0-0.5 | 0-0.1 |

The detergent compositions may be made using a mixing process. The components of the detergent composition including the aluminum hydroxycarboxylate, alkalinity source, surfactant or surfactant system and other functional ingredients are mixed for an amount of time sufficient to completely dissolve the components to form a final, homogeneous composition. In an exemplary embodiment, the components of the detergent composition are mixed for approximately 10 minutes.

The detergent compositions may include concentrate compositions or may be diluted to form use compositions. In general, a concentrate refers to a composition that is intended to be diluted with water to provide a use solution that contacts an object to provide the desired cleaning, rinsing or the like. The detergent composition that contacts the articles to be washed can be referred to as the use composition. The use solution can include additional functional ingredients at a level suitable for cleaning, rinsing, or the like. In an embodiment, the use solution includes additional functional ingredients of from about 0.05 wt % to about 75 wt %.

A use solution may be prepared from the concentrate by diluting the concentrate with water at a dilution ratio that provides a use solution having desired detersive properties. The water that is used to dilute the concentrate to form the use composition can be referred to as water of dilution or a diluent, and can vary from one location to another. The typical dilution factor is between approximately 1 and approximately 500 but will depend on factors including water hardness, the amount of soil to be removed and the like. In an embodiment, the concentrate is diluted at a ratio of between about 1:10 and about 1:10,000 concentrate to water. Particularly, the concentrate is diluted at a ratio of between about 1:100 and about 1:1500 concentrate to water. More particularly, the concentrate is diluted at a ratio of between about 1:250 and about 1:500 concentrate to water. When the detergent composition is diluted to a use solution, the aluminum hydroxycarboxylate is effective at concentrations of between about 20 parts per million (ppm) and about 400 ppm and particularly between about 40 ppm and about 140 ppm. In particular, the aluminum hydroxycarboxylate is effective at concentrations of less than approximately 100 ppm and less than approximately 40 ppm.

The use composition can have a solids content that is sufficient to provide the desired level of detersive properties while avoiding wasting the detergent composition. The solids concentration refers to the concentration of the non-water components in the use composition. In an embodiment when the detergent composition is provided as a use solution, the use composition can have a solids content of at least about 0.05 wt % to provide a desired level of cleaning. In addition, the use composition can have a solids content of less than about 1.0 wt % to avoid using too much of the composition. The use composition can have a solids content of about 0.05 wt % to about 0.75 wt %.

The concentrate may be diluted with water at the location of use to provide the use solution. The use solution is then applied onto the surface for an amount of time sufficient to remove soils from the surface. In an exemplary embodiment, the use solution remains on the surface for at least approximately 5 seconds to effectively remove the soils from the surface. The use solution is then rinsed from the surface.

A solid detergent composition as used in the present disclosure encompasses a variety of forms including, for example, solids, pellets, blocks, tablets, and powders. By way of example, pellets can have diameters of between about 1 mm and about 10 mm, tablets can have diameters of between about 1 mm and about 10 mm or between about 1 cm and about 10 cm, and blocks can have diameters of at least about 10 cm. It should be understood that the term "solid" refers to the state of the detergent composition under the expected conditions of storage and use of the solid detergent composition. In general, it is expected that the detergent composition will remain a solid when provided at a temperature of up to about 100° F. or lower than about 120° F.

In certain embodiments, the solid detergent composition is provided in the form of a unit dose. A unit dose refers to a solid detergent composition unit sized so that the entire unit is used during a single cycle, for example, a single washing cycle of a warewash machine. When the solid detergent composition is provided as a unit dose, it can have a mass of about 1 grams (g) to about 50 g. In other embodiments, the composition can be a solid, a pellet, or a tablet having a size of about 50 g to 250 g, of about 100 g or greater, or about 40 g to about 11,000 g.

In other embodiments, the solid detergent composition is provided in the form of a multiple-use solid, such as, a block or a plurality of pellets, and can be repeatedly used to generate aqueous detergent compositions for multiple washing cycles. In certain embodiments, the solid detergent composition is provided as a solid having a mass of about 5 g to about 10 kilograms (kg). In certain embodiments, a multiple-use form of the solid detergent composition has a mass of about 1 kg to about 10 kg. In further embodiments, a multiple-use form of the solid detergent composition has a mass of about 5 kg to about 8 kg. In other embodiments, a multiple-use form of the solid detergent composition has a mass of about 5 g to about 1 kg, or about 5 g and to about 500 g.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Laundry Test

To determine the ability of compositions of the present invention to remove soil, various laundering tests were performed. Compositions tested included an aluminum hydroxycarboxylate as a builder. A plurality of artificially soiled cotton, polycotton and cotton polyester durable press swatches were soiled and washed with the various compositions. The soils included make-up, dirty motor oil, soot/olive oil and dust sebum. The amount of soil present on each swatch was determined by measuring the reflectance, or lightness (L) value using a Hunterlab Colorquest XE spectrophotometer. Three large cotton napkin backers, each containing six different types of swatches, were attached to the cloth backers.

The washing machine was charged with about 25-28 pounds of cotton sheets along with the three backers which were evenly distributed inside the wash drum. Each laundry test was performed at a water temperature of about 140° F. Approximately 250 g of composition was used per wash.

After each wash, the swatches were dried and the reflectances (L-value) were again measured. The percent soil removed was calculated from the difference between the initial L value and the final L value. The soil removal value (SR) was calculated from the following equation:

$$SR=((L_w-L_{uw})/(L_0-L_{uw}))\times 100\%$$

Where:

SR=Soil removal (%)

$L_w$=Lightness of the washed swatch $L_{uw}$=Lightness of the soiled, unwashed swatch $L_0$=Lightness of the white swatch before soiling.

Generally, two detergents compositions were considered to perform substantially similarly, and thus function as effective replacements for one another, when the performance of the two detergents compositions did not vary by more than about 10%.

Example 1 and Comparative Examples A and B

The composition of Example 1 included a detergent composition of the present invention using an aluminum hydroxycarboxylate as a builder and linear alkyl sulfonate (LAS) as a base, a component known to have detersive properties. In particular, the composition of Example 1 included aluminum gluconate.

The composition of Comparative Example A included only included LAS and the composition of Comparative Example B included LAS and sodium tripolyphosphate (STPP), a component with known builder properties.

The component concentrations of the compositions of Example 1 and Comparative Examples A and B are illustrated below in Table 4.

TABLE 4

| | Example 1 | Comp. Example A | Comp. Example B |
|---|---|---|---|
| LAS (wt %) | 22.3 | 22.3 | 22.3 |
| STPP (wt %) | 0 | 0 | 15 |
| Aluminum Gluconate (wt %) | 15 | 0 | 0 |

The individual and average percent soil removal for the compositions of Example 1 and Comparative Examples A and B are listed below in Table 5.

TABLE 5

| | Average Soil Removal (%) | | |
|---|---|---|---|
| Soil | Example 1 | Comp. Ex. A | Comp. Ex. B |
| Makeup on Cotton | 18.25 | 14.78 | 22.25 |
| Dirty Motor Oil on Cotton | 2.65 | 4.48 | 6.42 |
| Olive Oil and Soot on Cotton | 16.77 | 14.39 | 21.75 |
| Olive Oil and Soot on Polycotton | 16.49 | 16.19 | 24.84 |
| Dust Sebum on Polycotton | 30.54 | 18.33 | 29.52 |
| Dust Sebum on Cotton | 48.33 | 43.17 | 49.14 |
| Average | 23 | 19 | 26 |
| Std. Deviation | 3 | 4 | 4 |

As can be seen in Table 5, the composition of Example 1 outperformed the composition of Comparative Example A, which included only LAS, on average by about 18%. When compared to the composition of Comparative Example B, the aluminum gluconate removed about 11.5% less soil on average. However, when the standard deviation is taken into account, there is less than a 10% difference in the performance of aluminum gluconate and STPP. Thus, aluminum gluconate is a suitable replacement for STPP as a builder in a laundry detergent.

Example 2 and Comparative Example C

The composition of Example 2 included a detergent composition of the present invention using Formula 1, a detergent available from Ecolab Inc., St. Paul, Minn., as the base, but replaced the EDTA in Formula 1 with aluminum gluconate on a 1:1 weight ratio basis.

The composition of Comparative Example C included only Formula 1, using EDTA as the builder.

The individual and average percent soil removal for the compositions of Example 2 and Comparative Example C are listed below in Table 6.

TABLE 6

| | Average Soil Removal (%) | |
|---|---|---|
| Soil | Example 2 | Comp. Ex. C |
| Makeup on Cotton | 19.85 | 21.96 |
| Dirty Motor Oil on Cotton | 6.55 | 4.58 |
| Olive Oil and Soot on Cotton | 20.32 | 15.82 |
| Olive Oil and Soot on Polycotton | 21.71 | 21.86 |
| Dust Sebum on Polycotton | 19.74 | 21.82 |
| Dust Sebum on Cotton | 34.88 | 37.77 |
| Average | 21 | 21 |
| Std. Deviation | 2 | 2 |

As illustrated in Table 6, the compositions of Example 2 and Comparative Example C performed substantially similarly. Thus, aluminum gluconate is a suitable replacement for EDTA as a builder in a laundry detergent.

Example 3 and Comparative Example D

The composition of Example 3 included a detergent composition of the present invention using Ecostar, a detergent available from Ecolab Inc., St. Paul, Minn., as the base and aluminum gluconate as a builder. In particular, the composition of Example 3 replaced the nitriltriacetic acid (NTA) in Formula 1 with aluminum gluconate on a 1:1 weight ratio basis.

The composition of Comparative Example D included Ecostar, using NTA as a builder.

The individual and average percent soil removal for the compositions of Example 3 and Comparative Example D are listed below in Table 7.

TABLE 7

| | Average Soil Removal (%) | |
|---|---|---|
| Soil | Example 3 | Comp. Ex. D |
| Makeup on Cotton | 14.01 | 23.91 |
| Dirty Motor Oil on Cotton | 4.45 | 3.85 |
| Olive Oil and Soot on Cotton | 17.40 | 14.49 |
| Olive Oil and Soot on Polycotton | 17.64 | 16.82 |
| Dust Sebum on Polycotton | 14.87 | 16.25 |
| Dust Sebum on Cotton | 21.45 | 25.90 |
| Average | 15 | 17 |
| Std. Deviation | 2 | 2 |

Table 7 shows that the composition of Example 3 removed about 11.3% less soil on average than the composition of Comparative Example D. However, when the standard deviation is taken into account, there is an overlapping performance of aluminum gluconate and NTA. Thus, aluminum gluconate is a suitable replacement for NTA as a builder in a laundry detergent.

Warewashing Test

To prepare plates for testing, a coffee dipper was filled with 17 grain hard water and heated to between about 185° F. and about 195° F. 150 Lipton tea bags were added and agitated for between about 5 minute and about 7 minutes. The tea bags were removed while squeezing the liquid out of them into the broth. The temperature in the dipper was then decreased to about 160° F. and about four 12 ounce cans of Carnation Evaporated Milk was added and stirred for about 30 minutes A set of 15 plates was added to the dipper and dipped 25 times at 1 minute in solution and 1 minute out of solution for each dip. If necessary, deionized water was added to the dipper to replace any water loss by evaporation.

To determine the ability of compositions of the present invention to remove soil, various warewashing tests were performed. Before the plates were washed, the amount of soil on the plates were noted. A sump was filled with 17 grain water and detergent was added. The warewash machine was allowed to run for one cycle. After making sure that the temperature is at between about 150° F. and 155° F., a set of 3 plates were placed on a rack and positioned in the warewash machine. The plates were washed and rinsed for one cycle. The plates were them removed and allowed to dry. The amount of soil remaining on the plates was noted.

Generally, two detergents compositions were considered to perform substantially similarly, and thus function as effective replacements for one another, when the performance of the two detergents compositions did not vary by more than about 10%.

Each of the compositions tested used Solid Power, a detergent available from Ecolab Inc., St. Paul, Minn. as a base.

Examples 4 and 5 and Comparative Examples E and F

The composition of Example 4 included a detergent composition of the present invention using Solid Power as the base but replacing the NTA in Solid Power with aluminum gluconate at a 1:1 weight ratio. The composition of Example 4 included aluminum gluconate formed at a 1:1 aluminum to gluconate ratio.

The composition of Comparative Example E included Solid Power and NTA, a known chelating agent.

The component concentrations of the compositions of Example 4 and Comparative Example E are illustrated below in Table 8.

TABLE 8

| | Stain Removal (%) |
|---|---|
| Example 4 | 91 ± 3 |
| Comp. Example E | 84 ± 8 |

As shown in Table 8, the composition of Example 4, which included aluminum gluconate, outperformed the composition of Comparative Example E, which included a known builder, in removing tea stains. Thus, aluminum gluconate is a suitable replacement for NTA in a warewashing detergent at a 1:1 weight replacement ratio.

After determining that a 1:1 weight ratio replacement of NTA with aluminum gluconate was effective at removing tea stains, the aluminum gluconate was tested against another known builder. Example 5 included a detergent composition of the present invention using aluminum gluconate as a builder formed at a 1:1 aluminum to gluconate ratio.

The composition of Comparative Example F included Solid Power detergent and Dissolvine GL-38, a known builder.

The component concentrations of the compositions of Example 5 and Comparative Example F are illustrated below in Table 9.

TABLE 9

| | Stain Removal (%) |
|---|---|
| Example 5 | 87 ± 6 |
| Comp. Example F | 52 ± 2 |

As shown in Table 9, the composition of Example 5 outperformed the composition of Comparative Example F on average by about 40%. Thus, aluminum gluconate is a suitable replacement for Dissolvine GL-38 in a warewashing detergent at a 1:1 weight replacement ratio.

Examples 4, 6 and 7 and Comparative Example G

Once it was determined that replacing known builders with aluminum gluconate at a 1:1 weight ratio still resulted in effective tea stain removal, various tests were run to determine the amount of aluminum gluconate needed to effectively remove the stains. In particular, the composition of Example 4 (above) included about 140 ppm aluminum gluconate, the composition of Example 6 included about 41 ppm aluminum gluconate and the composition of Example 7 included about 20.5 ppm aluminum gluconate.

The composition of Comparative Example G included about 140 ppm of NTA, a known builder.

Table 10 lists the component concentrations of the compositions of Examples 4, 6 and 7 and Comparative Example G as well as the percentage of stain removal from the plates treated with the compositions of Examples 4, 6 and 7 and Comparative Example G.

TABLE 10

| | Aluminum Gluconate (ppm) | NTA (ppm) | Stain Removal (%) |
|---|---|---|---|
| Example 4 | 140 | 0 | 91 ± 3 |
| Example 6 | 41 | 0 | 91 ± 6 |
| Example 7 | 20.5 | 0 | 92.9 ± 0.6 |
| Comp. Example G | 0 | 140 | 77 ± 6 |

Table 10 illustrates the ability of aluminum gluconate to remove stains at varying concentrations as compared to the ability of NTA to remove stains. In particular, even at 20.5 ppm, the aluminum gluconate removed over 17% more stains than 140 ppm of NTA. Therefore, aluminum gluconate is effective at removing stains at lower concentrations than NTA.

Examples 8 and 9 and Comparative Example H

The stain removal tests were then repeated with aluminum gluconate formed at varying ratios to determine whether the ratio of aluminum to gluconate effected the performance of the aluminum gluconate. In particular, the compositions of Examples 8 and 9 included aluminum gluconate formed at a 1:1.2 aluminum to gluconate ratio. The composition of Example 8 included about 140 ppm of aluminum gluconate while the composition of Example 9 included about 41 ppm of aluminum gluconate.

The composition of Comparative Example H included Solid Power detergent and NTA, a known builder.

The water and the wash temperature used for all of the washes were about 15 grain and about 152° F., respectively. The component concentrations of the compositions of Examples 8 and 9 and Comparative Example H are illustrated below in Table 11. Table 11 also lists the amount of stains removed from plates treated with the compositions of Examples 8 and 9 and Comparative Example H.

TABLE 11

| | Aluminum Gluconate (ppm) | NTA (ppm) | Stain Removal (%) |
|---|---|---|---|
| Example 8 | 140 | 0 | 92 ± 2 |
| Example 9 | 41 | 0 | 92 ± 3 |
| Comp. Example H | 0 | 140 | 86.9 ± 0.5 |

As can be seen in Table 11, even when the aluminum gluconate is formed having a ratio of aluminum to gluconate of slightly less than about 1:1, the aluminum gluconate was still able to remove a greater amount of stains than the composition of Comparative Example H. Even at a concentration of 41 ppm, the aluminum gluconate removed about 5.5% more than 140 ppm of NTA. Therefore, aluminum gluconate having an aluminum to gluconate ratio of slightly less than 1:1 is effective at removing stains at lower concentrations than NTA.

Examples 10 and 11 and Comparative Examples I and J

The ratio of aluminum to gluconate was then varied to about 1:4 aluminum to gluconate to test the ability of aluminum gluconate to remove stains at ratios less than 1:1. The composition of Example 10 replaced the NTA in Solid Power at a 1:1 weight ratio basis.

The composition of Comparative Example I included Solid Power detergent and NTA, a known builder.

The water and the wash temperature used for all of the washes were about 15 grain and about 152° F., respectively. Table 12 lists the stain removal ability of the compositions of Example 10 and Comparative Example I.

TABLE 12

| | Stain Removal (%) |
|---|---|
| Example 10 | 88 ± 5 |
| Comp. Example I | 65 ± 2 |

As can be seen in Table 12, even at a 1:4 aluminum to gluconate ratio, the composition of Example 10 removed about 26% more stains than NTA. Therefore, aluminum gluconate having an aluminum to gluconate ratio of about 1:4 is more effective at removing stains than NTA.

After determining that aluminum gluconate formed at a 1:4 aluminum to gluconate ratio has the ability to remove more stains than at least an equal amount of a NTA, aluminum gluconate formed at a 1:4 aluminum to gluconate ratio was tested against another known chelating agent. The composition of Example 11 included a detergent composition of the present invention using aluminum gluconate as a builder formed at a 1:4 aluminum to gluconate ratio.

The composition of Comparative Example J included Solid Power detergent and Dissolvine GL-38, a known builder.

The water and the wash temperature used for all of the washes were about 15 grain and about 152° F., respectively. Table 13 lists the percent of stains removed from plates treated with the compositions of Example 11 and Comparative Example J.

TABLE 13

| | Stain Removal (%) |
|---|---|
| Example 11 | 76 ± 10 |
| Comp. Example J | 44 ± 13 |

As shown in Table 13, even at a 1:4 aluminum to gluconate ratio, the composition of Example 11 removed about 42% more stains than the composition of Comparative Example J. Therefore, aluminum gluconate having an aluminum to gluconate ratio of about 1:4 is more effective at removing stains than Dissolvine GL-38.

Examples 12, 13 and 14 and Comparative Example K

The composition of Example 12 included a builder of the present invention. In particular, the composition of Example 13 included aluminum tartrate having a 2:1 mole ratio of tartrate to aluminum.

The composition of Comparative Example K include NTA as the builder.

Table 14 shows the stain removal properties of the compositions of Example 12 and Comparative Example K.

TABLE 14

| | Stain Removal (%) |
|---|---|
| Example 12 | 39 ± 15 |
| Comparative Example K | 13 ± 3 |

Although the amount of stains removed from the plates decreased for the compositions of Examples 12 and Comparative Example K, the data in Table 14 indicates that the aluminum tartrate performs better than NTA by almost 67%. It is believed that the compositions of Examples 12 and Comparative Example K did not perform as well as other compositions because the tea stains on the plates were more than 2 days old, making the tea stains more difficult to remove. Therefore, aluminum tartrate is a suitable replacement for at least NTA.

The same test was repeated 72 hours later on another group of plates from the same set. The composition of Example 13 included aluminum gluconate as the builder and the composition of Example 14 included aluminum tartrate having a 2:1 a mole ratio of tartrate to aluminum as the builder.

Table 15 shows the stain removal properties of the aluminum gluconate and aluminum tartrate after the tea stains had been on the plates for over 5 days.

TABLE 15

| | Stain Removal (%) |
|---|---|
| Example 13 | 9 ± 3 |
| Example 14 | 7 ± 4 |

Although the amount of stains removed from the plates decreased for the compositions of Examples 13 and 14, the data in Table 15 indicates that the aluminum gluconate performs slightly better than the aluminum tartrate. It is believed that the compositions of Examples 13 and 14 did not perform as well as other compositions because the tea stains on the plates were more than 5 days old, making the tea stains more difficult to remove. The compositions of Examples 12-14 do show that aluminum tartrate outperforms NTA and is similar to aluminum gluconate at removing tea stains. Therefore, it is expected that aluminum tartrate is more effective at removing tea stains than known commercial builders such as NTA and Dissolvine GL-38.

Hampshire Titration Test

To determine the capacity of a polymer to bind calcium, the polymer is titrated with a $CaCl_2$ solution in the presence of carbonate ions. The titration test measures the amount of calcium that can be added to a solution containing carbonate, an alkalinity source and aluminum hydroxycarboxylate before calcium carbonate begins to precipitate. The Hampshire titration test has been associated with the chelation capacity of the test sample.

A solution containing about 1 gram (g) of polymer, about 10 milliliters (ml) of 2% $Na_2CO_3$ and deionized water in an amount sufficient to give a total sample weight of 100 grams was heated to about 140° F. while stirring. When the temperature was stable at about 140° F., the pH was adjusted accordingly by the addition of 50% NaOH or 15.75% HCl. The solution was titrated with 0.25 M $CaCl_2$ until a distinct and permanent turbidity appeared. The stage prior to turbidity is recognized by a slight opalescence.

Example 15 and Comparative Example L

To determine the ability of an aluminum hydroxycarboxylate to bind calcium, the Hampshire titration test was performed. In particular, the composition of Example 15 included 1.87 mMols aluminum gluconate.

The composition of Comparative Example L was tested at the same conditions as the composition of Example 15 except that the composition of Comparative Example L included 2.09 mMols gluconate.

Table 16 provides the pH of the solution, end point, calcium mMols and Mol aluminum gluconate/Mol $Ca^{+2}$ and Mol $Ca^{+2}$/Mol aluminum gluconate for the composition of Example 17 and the pH of the solution, end point, calcium mMols and Mol gluconate/Mol $Ca^{+2}$ and Mol $Ca^{+2}$/Mol gluconate for the composition of Comparative Example L.

Food and Beverage Beaker Test

A reagent was first prepared by creating a hardness solution and a sodium bicarbonate solution. To create the hardness solution, about 33.45 grams of $CaCl_2.2H_2O$+23.24 g $MgCl_2.6H_2O$ was dissolved in a 1 liter volumetric flask and diluted to volume with deionized water. To create the sodium bicarbonate solution, about 56.25 grams of $NaHCO_3.2H_2O$ was dissolved in a 1 liter volumetric flask and diluted to volume with deionized water.

About 1000 milliliters (ml) of deionized water and a 1.5 inch stir bar was added to each of four 1000 or 1500 ml beakers. The beakers were placed on a hot plate and heated while about 5 mls of sodium bicarbonate solution was added. Once the water temperature reached about 85° F., the hardness solution was added to each beaker, with each 1 ml equaling about 2 grains, and run in 2 grain increments unless otherwise specified. About 4 mls of aluminum hydroxycarboxylate was added to each beaker, which is equal to about 0.40% or 1 ounce per 2 gallons. If the sample is thick or does not flow well, more sample was added based on the weight of 4 mls. After the sample is completely mixed, the stirrers are turned off.

When the temperature reached about 85° F., an initial transmittance reading was taken. Transmittance readings were also taken at 140° F. and 160° F. at 560 nm. 100% transmittance indicates that the solution is crystal clear and there is no formation of any precipitate. 99% or 98% transmittance is within the instrument and method error and are also considered as full clarity. Although at 90% transmittance the solution will look clear to the naked eye, some precipitation may be starting to form. Thus, if the percent transmittance is between about 98% and about 100%, the solution is considered to be free of precipitate. Lower percentages of transmittance indicate some initial micro nucleation.

Example 16 and Comparative Example M

To determine the ability of an aluminum hydroxycarboxylate to bind calcium, the beaker test was performed with 300 ppm $Na_2CO_3$ and 330 ppm NaOH and 16 grain water hardness. In particular, the composition of Example 16 included aluminum glucoheptonate.

The composition of Comparative Example M was tested at the same conditions as the composition of Example 16 except that the composition of Comparative Example M included only sodium glucoheptonate.

TABLE 16

| pH | 9 | 9.5 | 10 | 10.5 | 11 | 11.5 | 12 | 12.5 | 13 | 13.5 | 14 |
|---|---|---|---|---|---|---|---|---|---|---|---|
| Example 15 - Chelation of Ca by Aluminum Gluconate | | | | | | | | | | | |
| End pt. (ml) | 7.47 | 9.23 | 5.25 | 5.32 | 6.38 | 8.5 | 9.42 | 10.13 | NA | NA | NA |
| Ca mMols | 1.87 | 2.31 | 1.31 | 1.33 | 1.6 | 2.13 | 2.36 | 2.53 | NA | NA | NA |
| Mol aluminum gluconate/Mol $Ca^{+2}$ | 1.01 | 0.81 | 1.43 | 1.41 | 1.18 | 0.89 | 0.8 | 0.74 | NA | NA | NA |
| Mol $Ca^{+2}$/Mol aluminum gluconate | 0.99 | 1.23 | 0.7 | 0.71 | 0.85 | 1.13 | 1.25 | 1.35 | NA | NA | NA |
| Comparative Example L - Chelation of Ca by Gluconate | | | | | | | | | | | |
| End pt. (ml) | 1.13 | 0.4 | 0.55 | 0.517 | 0.617 | 0.65 | 0.55 | 0.866 | 0.283 | 0.2 | 0.15 |
| Ca mMols | 0.283 | 0.100 | 0.138 | 0.129 | 0.154 | 0.163 | 0.138 | 0.217 | 0.071 | 0.050 | 0.038 |
| Mol gluconate/Mol $Ca^{+2}$ | 7.40 | 20.90 | 15.20 | 16.17 | 13.55 | 12.86 | 15.20 | 9.65 | 29.54 | 41.80 | 55.73 |
| Mol $Ca^{+2}$/Mol gluconate | 0.14 | 0.05 | 0.07 | 0.06 | 0.07 | 0.08 | 0.07 | 01 | 0.03 | 0.02 | 0.02 |

The data in Table 16 shows that 1 mole of aluminum gluconate can chelate approximately 1 mole of calcium within a pH range of 9 to 12.5 at room temperature. By contrast, 15 moles of gluconate are needed to chelate 1 mole of calcium within a pH range of 9 to 12.5 at room temperature As the pH increased, even more moles of gluconate were needed to chelate 1 mol of calcium.

Table 17 provides the mol ratio of aluminum glucoheptonate to water hardness and the percent transmittance through the solution at 85 degrees Fahrenheit, 140 degrees Fahrenheit and 160 degrees Fahrenheit for the compositions of Example 16 and Comparative Example M.

TABLE 17

| | | Temperature (° F.) | | | |
|---|---|---|---|---|---|
| | Ratio | 85 | 140 | 160 | Comments |
| Example 16 | 1:1 | 95% | 95% | 76% | Hazy initially, became cloudy while heating, precipitated |
| | 2:1 | 99% | 98% | 93% | Clear until 158° F., then hazy and cloudy while cooling, precipitated |
| | 3:1 | 99% | 99% | 99% | Clear through heating and turned hazy while cooling |
| | 4:1 | 99% | 99% | 99% | Clear through heating and cooling |
| Comparative Example M | 1:1 | Failed | Failed | Failed | Failed |
| | 2:1 | Failed | Failed | Failed | Failed |
| | 3:1 | Failed | Failed | Failed | Failed |
| | 4:1 | Failed | Failed | Failed | Failed |

As can be seen from the results of the compositions of Comparative Example M in Table 17, even at a 4:1 ratio, glucoheptonate by itself was not able to chelate calcium and thus was not able to control the precipitation of calcium carbonate. By contrast, the aluminum glucoheptonate (Example 16) was able to control the precipitation of calcium carbonate when there was twice the molar amount of aluminum glucoheptonate to calcium, up to 140° F. However, this condition did not hold as the solution cooled down. At a 3:1 molar ratio, the aluminum glucoheptonate was able to prevent the precipitation of calcium carbonate. The effectiveness of the aluminum glucoheptonate to control the precipitation of calcium carbonate increased further at a ratio of 4:1.

Example 17 and Comparative Example N

The composition of Example 17 included aluminum mucate and was tested with 300 ppm $Na_2CO_3$ and 330 ppm NaOH and a 16 grain water hardness.

The composition of Comparative Example N was tested at the same conditions as the composition of Example 17 except that the composition of Comparative Example N included sodium mucate.

Table 18 provides the polymer to water hardness ratio and the percent transmittance through the solution at 85 degrees Fahrenheit, 140 degrees Fahrenheit and 160 degrees Fahrenheit for the compositions of Example 17 and Comparative Example N.

TABLE 18

| | | Temperature | | | |
|---|---|---|---|---|---|
| | Ratio | 85 | 140 | 160 | Comments |
| Example 17 | 1:1 | 98% | 98% | 98% | Slight bluish/gray hue initially, hazy, became cloudy while cooling, precipitated |
| | 2:1 | 100% | 100% | 100% | Clear through heating and cooling |
| | 1.33:1 | 100% | 100% | 100% | Clear through heating and cooling |
| | 1.14:1 | 100% | 100% | 100% | Clear through heating and cooling |
| Comparative Example N | 1:1 | Failed | Failed | Failed | Failed |
| | 2:1 | Failed | Failed | Failed | Failed |
| | 1.33:1 | Failed | Failed | Failed | Failed |
| | 1.14:1 | Failed | Failed | Failed | Failed |

As can be seen in Table 18, mucic acid by itself was not able to chelate calcium at a 1:1 or 2:1 ratio at all temperatures. By contrast, aluminum mucate was able to prevent the precipitation of calcium carbonate at a 1:1 ratio. However, as the solution cooled, the aluminum mucate was not effective at controlling precipitation of calcium carbonate, eventually exhibiting some precipitation in solution. Once it was determined that the aluminum mucate could prevent the precipitation of calcium carbonate at a 2:1 ratio, aluminum mucate was tested at slightly lower ratios to determine at what point the aluminum mucate became effective. When tested at a ratio of 1.14:1, the aluminum mucate was able to prevent the precipitation of calcium carbonate at 85, 140 and 160 degrees Fahrenheit.

Solubility Test

To determine the ability of the present compositions to solubilize calcium, two calcium compounds of different solubilities were prepared, hydroxylapatite ($Ca_5(PO_4)_3(OH)$) and dibasic calcium phosphate ($CaHPO_4$). $Ca_5(PO_4)_3(OH)$ is much more insoluble than $CaHPO_4$. The slurries were stirred and heated to about 140° F. Both slurries had a white opaque coloring. About 100 ml of 1 mol/L aluminum gluconate was then slowly added to each of the slurries.

The composition of Example 18 included the addition of the aluminum gluconate to the dibasic calcium phosphate slurry and the composition of Comparative Example O included the addition of the aluminum gluconate to the hydroxylapatite slurry. Table 19 shows the calcium source, amount of calcium and results for the compositions of Example 18 and Comparative Example O.

TABLE 19

| | Calcium Source | Starting Ca (mol) | Results |
|---|---|---|---|
| Example 18 | Dibasic calcium phosphate | 0.1 | Clear |
| Comp. Example O | Hydroxylapatite | 0.05 | Opaque |

As can be seen by the results in Table 19, the hydroxylapatite had no clarification when the aluminum gluconate was added while the dibasic calcium phosphate had considerable clarification within 10 minutes of the last of the aluminum gluconate being added. Even though the amount of calcium in the dibasic calcium phosphate was higher than the hydroxylapatite, the aluminum gluconate was able to dissolve the dibasic calcium phosphate.

In further testing, the solubility of $CaHPO_4$ was tested using gluconate and aluminum gluconate. The procedure was similar to the one used above. A gluconate species/calcium molar ratio was used to indicate the amount of gluconate species needed to complex with calcium in the system. The lower the molar ratio, the less gluconate species needed.

The composition of Example 19 included the addition of the aluminum gluconate to the dibasic calcium phosphate slurry and the composition of Comparative Example P included the addition of the aluminum gluconate to the dibasic calcium phosphate slurry. Table 20 shows the amount of calcium, the amount of gluconate, the results, and the gluconate compound to calcium ratio for the compositions of Example 19 and Comparative Example P.

TABLE 20

| | Starting Ca (mol) | Gluconate Compound Used (mol) | Results | Gluconate compound/Ca ratio |
|---|---|---|---|---|
| Example 19 | 0.201 | 1.0 | Clear but slightly hazy | 4.97 |
| Comp. Example P | 0.002 | 0.388 | Slightly less opaque | 193.04 |

As can be seen by the results in table 20, the gluconate to calcium ratio of the composition of Example 19 was much lower than the gluconate to calcium ratio of the composition of Comparative Example P. In particular, the ratio for the composition of Example 19 was about 95% less than the ratio for the composition of Comparative Example P. Thus, the aluminum gluconate performed better than the gluconate at solubilizing the dibasic calcium phosphate.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A cleaning composition for removing soils comprising:
(a) an aluminum salt;
(b) a hydroxycarboxylate; and
(c) an alkalinity source;
(d) wherein the pH of the cleaning composition is between about 9 and about 14.

2. The cleaning composition of claim 1, wherein the aluminum salt and the hydroxycarboxylate combine to form an aluminum hydroxycarboxylate.

3. The cleaning composition of claim 2, wherein the aluminum hydroxycarboxylate comprises one of aluminum gluconate, aluminum glucoheptonate, aluminum mucate, aluminum tartrate, aluminum glucarate, aluminum saccharate and aluminum malate.

4. The cleaning composition of claim 2, wherein the aluminum hydroxycarboxylate comprises aluminum gluconate.

5. The cleaning composition of claim 4, wherein the aluminum gluconate has a molar ratio of between about 0.5:1.5 and about 1.5:0.5 gluconic acid to sodium aluminate.

6. The cleaning composition of claim 1, further comprising a surfactant.

7. The cleaning composition of claim 2, wherein the aluminum hydroxycarboxylate has a weight ratio of between about 40:60 and about 95:1 alkali metal salt of a hydroxycarboxylate or free hydroxycarboxylic acid to aluminum salt dissolved with an alkali metal hydroxide.

8. A detergent composition comprising:
(a) an alkalinity source constituting between about 0.8% and about 90% by weight of the detergent composition; and
(b) an aluminum hydroxycarboxylate constituting between about 0.01% and about 60% by weight of the detergent composition, wherein the aluminum hydroxycarboxylate comprises one of aluminum gluconate, aluminum glucoheptonate, aluminum mucate, aluminum tartrate, aluminum glucarate, aluminum saccharate and aluminum malate.

9. The detergent composition of claim 8, wherein the aluminum hydroxycarboxylate comprises aluminum gluconate and wherein the aluminum gluconate has a molar ratio of between about 0.5:1.5 and about 1.5:0.5 gluconic acid to sodium aluminate.

10. The detergent composition of claim 8, wherein the aluminum hydroxycarboxylate has a weight ratio of between about 40:60 and about 95:1 alkali metal salt of a hydroxycarboxylate or free hydroxycarboxylic acid to aluminum salt dissolved with an alkali metal hydroxide.

11. The detergent composition of claim 8, wherein the detergent composition comprises less than about 10% NTA and EDTA by weight.

12. The detergent composition of claim 8, wherein the detergent composition comprises less than about 10% phosphorous-containing compounds by weight.

13. The detergent composition of claim 8, wherein the detergent composition comprises less than about 10% sulfonated or sulfated surfactant by weight.

14. The detergent composition of claim 8, further comprising a surfactant system constituting between about 0.01% and about 50% by weight of the detergent composition.

15. A method of removing soils comprising:
(a) providing a detergent composition comprising:
(i) an alkalinity source; and
(ii) an aluminum hydroxycarboxylate formed from an alkali metal salt of a hydroxycarboxylate or free hydroxycarboxylic acid and an aluminum salt dissolved with an alkali metal hydroxide; and (b) contacting the detergent composition with a substrate to be cleaned.

16. The method of claim 15, wherein the detergent composition further comprises a surfactant system.

17. The method of claim 16, wherein providing a detergent composition comprises mixing the alkalinity source and the surfactant system separately from the aluminum hydroxycarboxylate.

18. The method of claim 15, wherein the aluminum hydroxycarboxylate has a weight ratio of between about 40:60 and about 95:1 alkali metal salt of a hydroxycarboxylate or free hydroxycarboxylic acid to aluminum salt dissolved with an alkali metal hydroxide.

19. The method of claim 15, further comprising diluting the detergent composition at a dilution ratio of between about 1:10 and about 1:10,000 to form a use solution.

20. The method of claim 19, wherein the use solution has an aluminum hydroxycarboxylate concentration of less than about 400 parts per million.

* * * * *